United States Patent [19]

Reigstad et al.

[11] Patent Number: 4,574,545

[45] Date of Patent: Mar. 11, 1986

[54] METHOD FOR INSTALLING OR REPLACING TENDONS IN PRESTRESSED CONCRETE SLABS

[75] Inventors: Gordon H. Reigstad, North St. Paul; A. Norris Breivik, South St. Paul; Hanley S. Reigstad, Sunburg, all of Minn.

[73] Assignee: Breivik-Reigstad, Inc., St. Paul, Minn.

[21] Appl. No.: 595,285

[22] Filed: Mar. 30, 1984

[51] Int. Cl.[4] ..... E04C 5/08

[52] U.S. Cl. ..... 52/223 R; 52/741; 264/36; 264/228; 264/229

[58] Field of Search ..... 52/223 R, 223 L, 227, 52/230, 231, 222, 583, 587, 600, 741, 742, 743, 745, 746, 747, 749, 750; 404/107; 264/36, 228, 229

[56] References Cited

U.S. PATENT DOCUMENTS

| | | | |
|---|---|---|---|
| 2,686,963 | 8/1954 | Freyssinet | 52/230 |
| 3,029,490 | 4/1962 | Middendorf | 52/223 L |
| 3,036,356 | 5/1962 | Greulich | 52/223 R |
| 3,086,273 | 4/1963 | Welsorn | 52/223 R |
| 3,605,202 | 9/1971 | Valenzuela | 52/223 L |
| 3,774,359 | 11/1973 | Kahn | 52/223 R |
| 4,125,978 | 11/1978 | Schildge, Jr. | 52/223 R |
| 4,149,306 | 4/1979 | Tice | 264/228 |
| 4,185,440 | 1/1980 | Finsterwalder | 52/223 R |
| 4,449,855 | 5/1984 | Langwadt | 52/223 R |

*Primary Examiner*—John E. Murtagh
*Assistant Examiner*—Andrew Joseph Rudy
*Attorney, Agent, or Firm*—Merchant, Gould, Smith, Edell, Welter & Schmidt

[57] ABSTRACT

A method for installing a new steel tendon and for repairing a damaged or deteriorated steel tendon in a prestressed concrete slab is disclosed. The repair method includes the steps of relieving substantially all stress in the defective original tendon, removing the original tendon, installing a new tendon in the space vacated by the original tendon, installing new concrete around the new tendon to replace any original concrete removed while removing the original tendon, and stressing the new tendon thereby again prestressing the previously structurally defective slab. Installation of a tendon where none has previously existed is similar except an original tendon need not be removed.

17 Claims, 16 Drawing Figures

20
22
24
28
64
66
70
72
74
97
98
100
101
102
104
106
108
110
112

METHOD FOR INSTALLING OR REPLACING TENDONS IN PRESTRESSED CONCRETE SLABS

TECHNICAL FIELD

The present invention is directed to a method for installing or replacing tendons in prestressed concrete slabs of, for example, parking ramps and bridges. Prestressed concrete slabs contain steel tendons stressed so as to compress the slab before it is loaded. Such tendons can rust and break thereby releasing the stress level and weakening the slab. The present invention identifies a method for removing and replacing the damaged or deteriorated tendon with a new tendon which is then stressed to restore loading strength to the slab. The present method is also applicable for adding tendons to prestressed slabs to increase load capacity.

BACKGROUND OF THE INVENTION

Prestressed concrete is a type of reinforced concrete slab which has been subjected to an external compressive force prior to the application of loads. Prestressed concrete is categorized as either pre-tension or post-tension. Pre-tension refers to the method of first stressing tendons and then casting concrete around the prestressed tendons. The concrete cures before releasing the prestressed tendons and transferring the stress from the tendons to the concrete. A tendon comprises prestressing assemblage including steel systems, anchor mechanisms, coatings and sheathings.

Post-tension refers to the method of casting wet concrete around unstressed tendons and then stressing the tendons after the concrete has reached specified strength. Post-tension concrete is generally categorized further as being either bonded or unbonded. Post-tension concrete which is bonded refers to the tendons generally being covered with a duct or pipe or conduit such that after the concrete around the duct, for example, has set and cured, the tendon is stressed and a grout material generally consisting of cement, sand, aggregate and water is pumped into the cavity surrounding the wire system so that the space between the walls of the conduit and the steel is completely encased in grout. Unbonded post-tension concrete refers to the use of greased or paper wrapped or plastic covered wire systems around which the concrete is cast. The unbonded system is permanently without bond between the steel and the concrete because of the grease, paper or plastic.

Although the modern method of prestressing concrete may be traced to the late 1920's, its general use in the United States did not begin until the late 1940's or early 1950's. General acceptance and the primary increase in use occurred primarily between 1965 and 1975. Application of prestressing was being made in all aspects of construction including buildings, towers, floating terminals, ocean structures and ships, storage tanks, nuclear containment vessels, bridge piers, bridge decks, foundations, soil anchors, and virtually all other types of installations where normal reinforced concrete was acceptable. Thus, prestressed concrete and methods for its initial installation for diverse applications is now well known.

After years of service, however, problems associated with prestressed concrete structures became apparent. The problems appeared primarily on consideration of future use of structures and/or maintenance of deteriorated or damaged structures.

In the 1960's and 1970's, it was common to build multistoried parking ramp structures for automobiles. About that same period, public utilities began relying on the application of calcium chloride or sodium chloride to remove or reduce the effect of ice and snow on bridges and roads. In addition, automobiles day after day and year after year would carry the calcium chloride or sodium chloride into the parking structures. It is now known that the chloride ion leaches or otherwise moves into concrete slabs. In contact with reinforcing steel, the chloride ion has caused considerable corrosion. It has not mattered whether the steel was normal reinforcing steel or steel used for prestressing tendons. Bridges and parking structures estimated to have useful maintenance free lives of 10 to 25 years are now requiring maintenance in only 7 to 15 years.

Thus, as corrosion of the prestressing steel and the normal reinforcing steel became apparent, it became necessary to provide for methods of maintenance, repair, and replacement of distressed decks and floors. The accepted method for repair became total slab removal and replacement. Partial removal and replacement of a concrete slab containing tensioned tendons was generally not possible. In most cases, the tensioned concrete deck or slab was two directional having tensioned tendons running at right angles to one another. Removal of concrete in one direction allowed deformation in the other direction. Even if the slab was generally one directional, the use of secondary tendons for shrinkage control was widely accepted and therefore tendons still ran at right angles to primary reinforcement. Thus, the prestressing concept, widely accepted a decade or two ago, is now shocking structure owners as complete slab replacement becomes necessary, even though only two to four percent of total slab surface area is damaged. Even more frightening, however, are the consequences to the general public if a structure owner in view of repair costs performs only cosmetic repair and allows the strength of slabs to deteriorate to the point of collapse.

SUMMARY OF THE INVENTION

The present invention is directed to a method for further reinforcing an existing prestressed slab or replacing a single damaged or deteriorated tendon without removing and replacing the entire slab. In general, for repair the method comprises the steps of relieving substantially all stress in the original tendon before removing the original tendon from the slab. A new tendon is then installed in the space from which the original tendon was removed. New concrete is installed around the new tendon to replace any original concrete removed while removing the original tendon and the new tendon is stressed thereby again prestressing the slab. For adding a tendon not previously present, a space is chipped into the concrete slab similar to the space created by a removed, damaged tendon, then the new tendon is installed.

More particularly, the present method specifies removing original concrete from nonfacing sides of the original end anchors and, for wire reinforcing systems, cutting the buttons or retaining mechanisms for each wire at the stressing end anchor. With all stress in the original tendon relieved, additional original concrete may be removed in order to remove all original anchor mechanisms. Next, original concrete is removed in locations over each beam down to the wire bundle of the tendon and the wire bundle is severed. At this point removal and replacement of the wires may proceed in a couple of different ways. First, a pulling mechanism such as a hydraulic jack may be anchored with respect to any particular section of the severed wire bundle. One of the severed wires in the bundle is fastened to the pulling mechanism and pulled from the slab. Each wire is thereafter pulled in a similar fashion. With all wires pulled, a working strand is placed in the vacated passage and attached at one end to a broach and at a second end to the pulling mechanism. The broach is pulled through the passage to clean and enlarge the passage. Additional broaches of increasingly larger size may be pulled through the passage to shape and enlarge the passage as desired. Next, the passage and areas where concrete has been removed are prepared for installation of new concrete. New anchor mechanisms are fixed solidly in place and a new wire system is threaded through the prepared passages and fastened as appropriate to the new anchor mechanisms to form the new tendon. The anchor mechanisms are fastened in place with new concrete, and a tensile force is applied to the tendon and held. Excess wire is cut off at the stressing anchor mechanism. Additional new concrete is cast as required to restore the surfaces of the slab to substantially the shape they were before deterioration or removal.

A second method for removal of the defective tendon may be used in conjunction with the first method or in place of the first method. The second method specifies removing original concrete alternately from the top and bottom of the slab in order to expose the entire length of the wire bundle for easy removal. More particularly, concrete removal is begun at a beam. Original concrete is removed down to and slightly to each side of the wire bundle extending along the wire bundle in each direction to points where the wire bundle is embedded in the slab for approximately one-half the thickness of the slab. At these locations, called transition points, original concrete is removed the full depth of the slab. Proceeding further along the wire bundle, concrete is removed in the form of an inverted trench form beneath the slab. That is, concrete is removed up to and slightly to each side of the wire bundle in regions where the wire bundle is embedded in the slab approximately one-half the thickness of the slab or more. The method may be accomplished by doing all the trenching on the top of the slab first and then on the bottom or by proceeding along the wire bundle in one direction from top to bottom to top, etc., and then the other direction to the tendon ends. After the wire bundle is completely exposed, it is removed. Then, similar to the first method, new anchor mechanisms are emplaced and a new wire system is installed between the anchor mechanisms. Forms are placed along the underside of the slab under the inverted trenches to form a cover or bottom for the trenches. New concrete is then forced through the transition holes to fill the inverted trenches. New concrete is also cast in the upright trenches. A tensile force is applied to the new tendon, and excess wire is cut at the stressing anchor mechanism. Finally, as before, new concrete is cast, as required, around the anchor mechanisms and any other places as required to provide the slab with surfaces as it previously had. This second method is also appropriate for installing tendons where none had previously been.

As indicated, primary tendons are near the top surface of the slab over beams and are near the bottom surface of the slab between beams. Corrosion occurs most commonly at the locations where the tendons are most near the top of the slab, however corrosion can occur at any point along the tendon and also in the tendon anchorages. As corrosion occurs, a tendon expands and causes concrete swelling. Thus, it becomes apparent when a particular tendon is deteriorating and has likely lost structural effectiveness. Rather than completely rebuild the slab when one or a few tendons have corroded, the present method advantageously allows replacement of single tendons without causing structural damage to the slab during the repair process or as a result of the repair process. Thus, the method of the present invention is incredibly less expensive than presently used repair procedures requiring complete replacement of a slab. Of even more importance, the present method is affordable for virtually all structure owners thus making it much more likely that structural, rather than cosmetic, repair will be accomplished.

The present method is further advantageous in that it may be accomplished by working in the localized area of the defective tendon so that an entire parking ramp, for example, need not be shut down. Furthermore, the repair method may be accomplished usually within a few hours.

These advantages and other objects obtained by the method of the present invention are further explained and may be better understood by reference to the sketches described briefly hereinafter and explained in detail in the following descriptive matter. Although a preferred method and alternative of the present invention is illustrated and described, it is understood that the disclosure is representative and that the claims define the true extent of this important invention.

DETAILED DESCRIPTION OF THE PREFERRED EMBODIMENT

Figure 1:
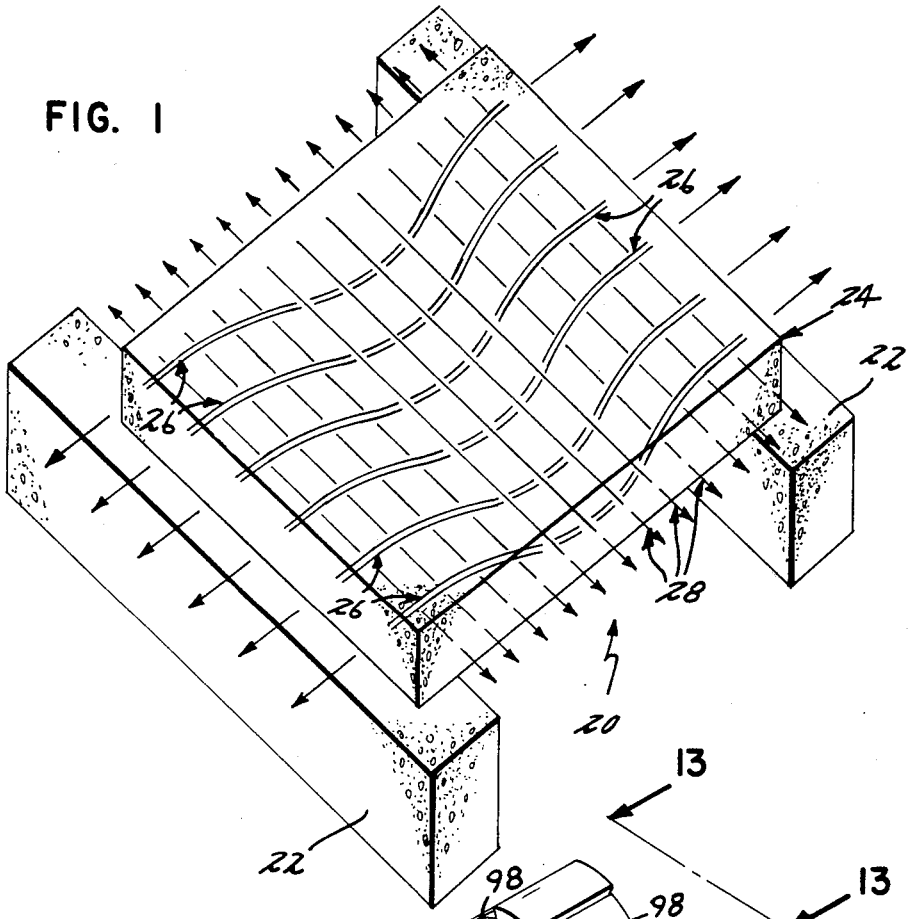
FIG. 1 is an illustration in perspective of a portion of a prestressed slab as it extends between two beams.

Referring now to the drawings, it is noted that like reference numerals are used throughout the several views to designate identical or corresponding parts. In FIG. 1, a typical bay 20 is shown as defined by a pair of spaced-apart, parallel beams 22 which support a slab 24. Slab 24 is prestressed with primary tendons 26 extending in one direction and temperature tendons 28 extending perpendicular to the primary tendons.

Figure 2:
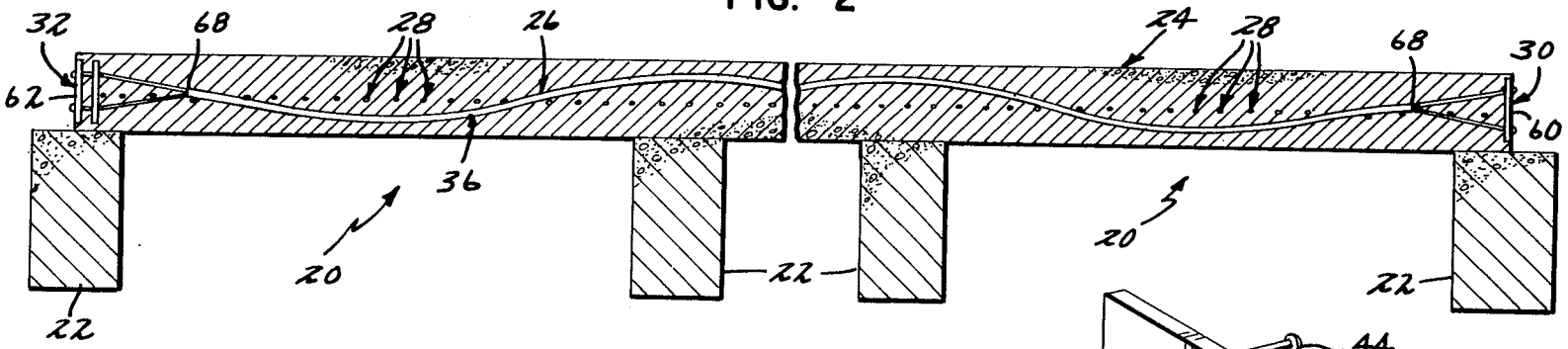
FIG. 2 is a cross-sectional, side elevation illustration showing the typical profile of a primary stressing tendon.

As indicated previously, concrete slabs may be formed using non-tension reinforcing steel. Such a slab typically requires considerable amounts of steel, and the slab is relatively thick. Concrete slabs which are placed under compression or are prestressed, however, require less steel and may be thinner. The tensioning steel for prestressed concrete, however, must be placed relatively precisely so that when tension is exerted on the steel, preplanned strength characteristics develop in the slab. For example, a non-tensioned slab extending between two beams sags slightly in the middle so that the bottom of the slab is in tension while the top of the slab is in compression. A tensioned slab, on the other hand, is designed to place essentially the entire thickness of the slab in compression thereby strengthening the slab. A typical profile for a primary tendon 26 is shown in FIG. 2. Tendon 26 is essentially formed in a wave pattern having high portions over beams and low portions midway between beams. A dead anchor 30 and a stressing anchor 32 are attached at opposite ends. When a tensile force is applied at the stressing anchor, the lower portions of the tendon 26 raise slab 24 slightly while the higher portions of tendon 26 compress downwardly onto beams 22. In effect, tendon 26 slightly bows slab 24 upwardly between beams 22 thereby tending to cause the lower portion of slab 24 to go into compression while the upper portion experiences less compression and theoretically could even experience some tendency toward separation. Desirably, sufficient tensile force may be applied to place the entire thickness of slab 24 between beams 22 in compression. Considering FIG. 1 again, each of the various primary tendons 26 may be considered imaginary side by side beams extending between beams 22. The function, then, of the temperature tendons is effectively to compress the imaginary beams of the primary tendons together to form a high strength slab. Primary tendons 26 are ordinarily placed to provide a compressive stress in the concrete of several hundred pounds per square inch while temperature tendons 28 are placed to provide a smaller compressive stress in the concrete slab. Nevertheless, there is typically compressive stress on a prestressed concrete slab in both directions, and, in any case, it is understood that the illustration of the present disclosure is exemplary and that other prestressing designs may be equally applicable. The present discussion, however, points out rather simply the concept underlying prestressing, and the design illustrated is useful for that purpose.

Figure 3:
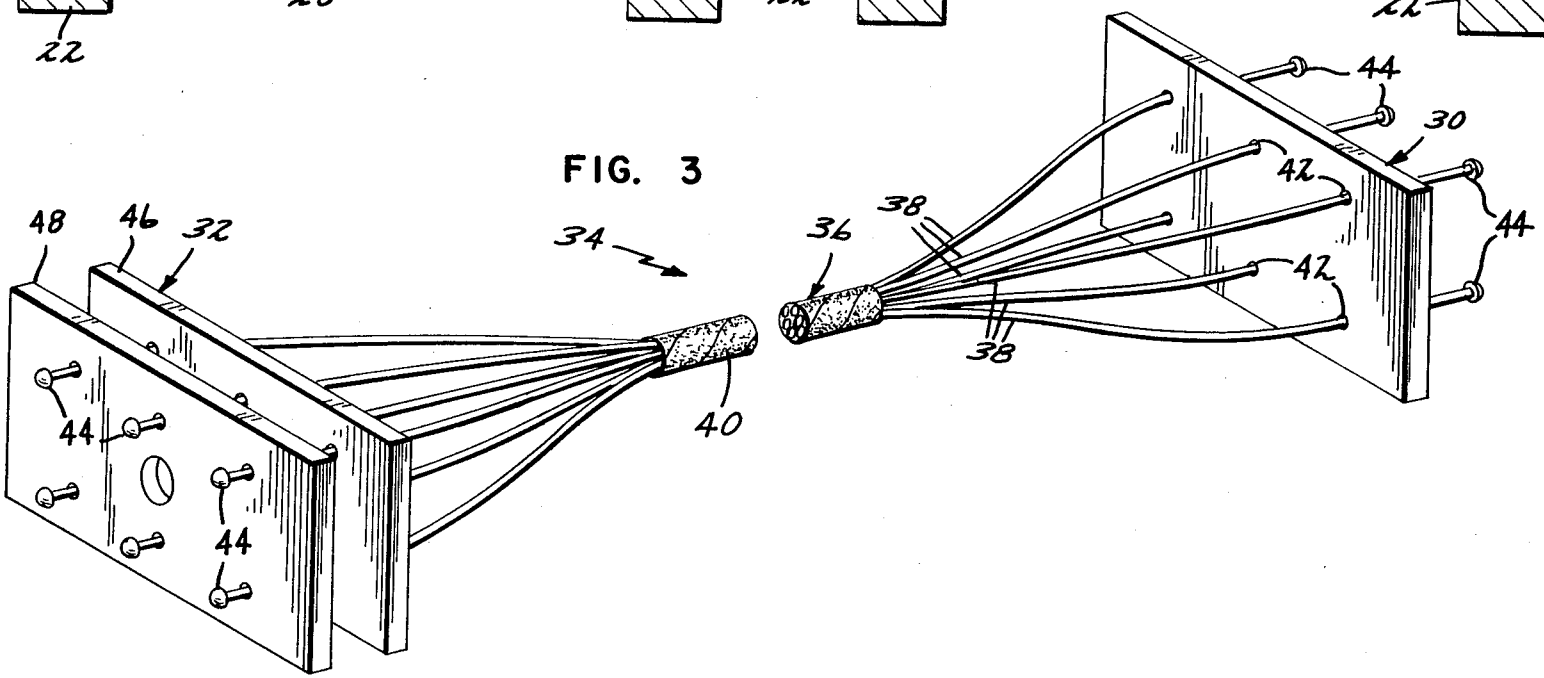
FIG. 3 is an enlarged perspective of a typical tendon showing anchors and wires.

A representative tendon 34 is shown in FIG. 3. Tendon 34 could be used as a primary tendon 26 or as a temperature tendon 28. The difference between the two would depend on the orientation with respect to the beams as described hereinbefore, the amount and quality of steel, and the tensile force applied. Tendon 34 includes a wire bundle 36 comprised of a plurality of individual wires 38. Bundle 36 is typically coated, lubricated, wrapped or encased in any of a variety of materials, including but not limited to epoxy coating, a variety of greases, paper wrapping, vinyl wrapping, polyvinyl chloride sheathing, vinyl extrusions, vinyl jackets, polypropylene, or rigid or flexible metal conduits or some other similar type device, coating, or enclosure 40. Each wire passes through an opening 42 in dead anchor 30 and has a button 44 or other retaining feature on the far side to prevent the wire from pulling back through when a tensile force is applied. A typical stressing anchor 32 includes a pair of plates 46 and 48. Wires 38 pass through both and have buttons or other retaining devices on the ends to prevent the wires from pulling back through outer plate 48. Typically, outer plate 48 is pulled by a hydraulic jack or some other force applying mechanism while plates 30 and 46 are retained in the concrete. When a desired tensile force has been applied and wires 38 have stretched, plates 46 and 48 are separated as shown in FIG. 3. The applied level of tensile force is then retained by inserting shims (not shown) between plates 46 and 48. As indicated, anchors 30 and 32 are representative, and it is understood that any of a variety of known anchors are equivalent.

Figure 4:
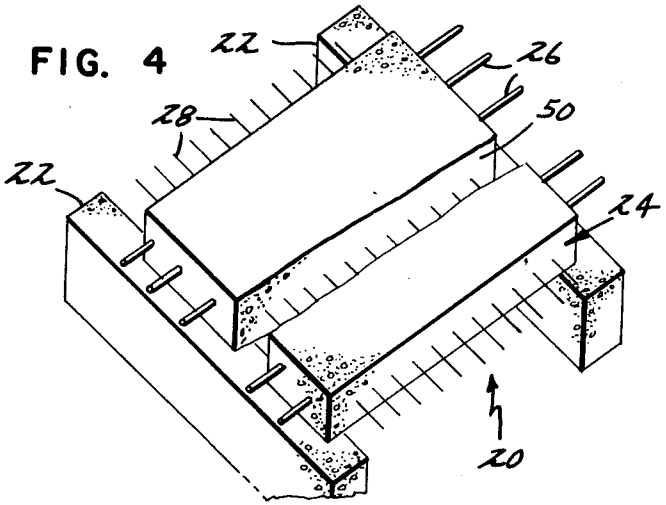
FIGS. 4–7 are illustrations in perspective, similar to FIG. 1, showing sequentially results of full depth concrete removal along a tendon.
Figure 5:
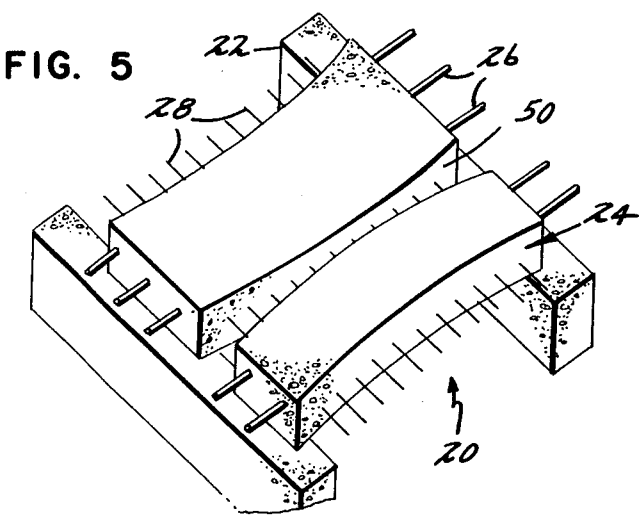
Figure 6:
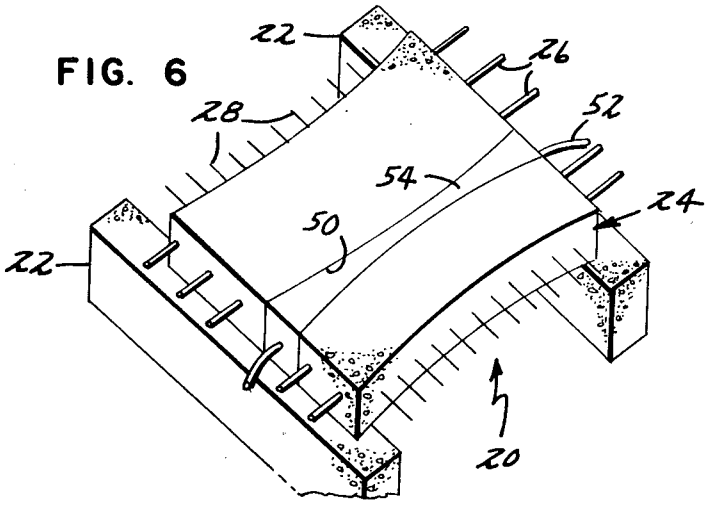
Figure 7:
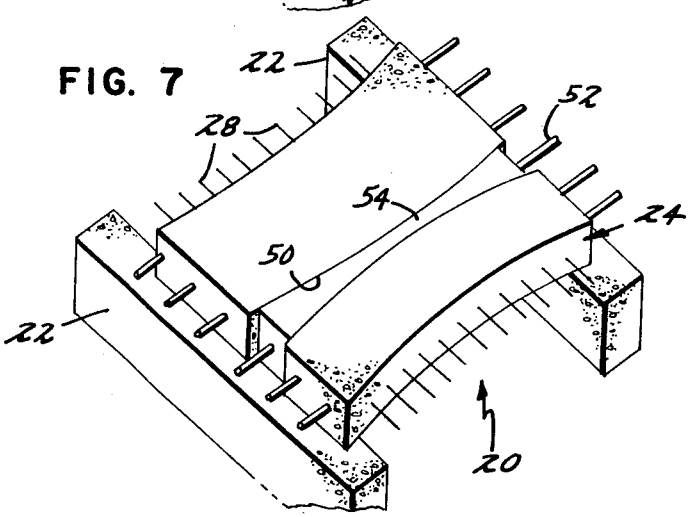

As indicated previously, the present slab repair method is to remove the entire slab and completely rebuild it. Until the present invention, there has been no less costly or simpler method. The present invention is more fully appreciated on consideration of an unacceptable procedure as shown in FIGS. 4–7. FIG. 4 illustrates full depth removal of concrete along a primary tendon. FIG. 5 shows temperature tendons causing the slab to deform inwardly near the middle of the removal channel 50, cracks and concrete separations may also occur in the remaining slab section. FIG. 6 shows an unstressed tendon 52 with concrete 54 cast around it, while FIG. 7 shows how the new concrete 54 compresses when the new tendon 52 is stressed. The deformation of the slab causes cracking and structural weakening before replacement of the new tendon and new concrete, while the stressing of the new concrete 54 with the new tendon 52 causes further cracking as the new concrete compresses with respect to the oil. Consequently, the theoretical method of FIGS. 4–7 is unacceptable.

The present invention then was identified and developed as a solution to providing tendon replacement in a slab in lieu of the unacceptable concept of full depth removal of concrete along a single tendon in a slab. The inventive method provides for selected removal of concrete from areas around the anchorage and from around the prestressing strand, wire, or bar, and the replacement of a new reinforcing tendon including anchorages and new encasement in concrete. The method is applicable for all types of prestressed concrete including pre-tensioned and post-tensioned and including the use of wires, strand, or bars as tendons, both bonded and unbonded.

Before considering the method in more detail, however, it is helpful to identify the problem more specifically. Studies have shown that the chloride ion content at the surface of the floor of a parking ramp in a region using a salt for snow or ice control may be 20 to 40 times the ion content of the corrosion threshold for reinforcing steel. The chloride ion content diminishes rapidly at deeper and deeper depths into the concrete slab. However, it is not uncommon to have a chloride ion concentration of three to five times the corrosion threshold concentration at a depth of one to two inches. The problem then is that portions of post-tension reinforcing steel, in whatever form, are commonly at depths of one to two inches. Consider especially the profile of tendon 26 in FIG. 2. At locations over beams 22, tendon 26 is normally designed to be within two inches of the surface and may be as close as an inch or so. Consequently, it is usually the case that the tendon in this location corrodes first and is visible due to the expansion caused by the corrosion and the resulting spalling or breaking of concrete around the areas of the corroded steel. Conversely, when broken concrete results and is visible on the surface of the slab or deck, corrosion has usually proceeded to the point where strands have broken. Corrective measures to repair the tendon and the concrete and to maintain the structural integrity of the slab as a parking ramp or bridge or other application are then necessary.

Other reasons for replacing post-tensioning steel tendons included, but are not necessarily limited to:

1. Failure of the anchorages during initial construction when the tensioning of the steel is attempted before the surrounding concrete has achieved sufficient strength to resist the prestressing force. Failure will result from the bearing plate actually breaking out of the surface of the concrete requiring a repair of replacement of the tendon.
2. When defective jacking devices have imparted a tensile force into the tendon that is more than is safely tolerable for the lifetime of the structure. When this information is learned, it becomes necessary to remove the overstressed tendon and replace it with an identical tendon stressed to a lower level that was the original.
3. When workmen instaling new equipment or facilities on a post tensioned slab inadvertently sever a post-tensioning tendon while coring holes in the floor for pipes, conduits or ducts or when drilling into the slab to provide bolting anchors for new equipment.
4. Damage to the tendons caused by large internal or external forces such as explosions, collisions or impact on the post-tensioned slab.
5. Damage to tendons caused by elevated heat such as an uncontrolled fire, for example. When the steel temperatures have increased 800 degrees, more or less, the steel tendons have lost as much as 50% of the initial stressing force and may become permanently damaged, requiring replacement.

Briefly, the inventive method of repair includes the steps of relieving substantially all stress in an original tendon, removing the original tendon, installing a new tendon in place of the original tendon, installing new concrete around the new tendon to replace any original concrete removed, and stressing the new tendon thereby again prestressing the previously defective slab.

As indicated, the method requires, first, relieving substantially all stress in the original tendon. Consider FIG. 2. Stress in the tendon may be removed by completely severing the tendon anywhere along its length. More particularly, the stress relieving step may be accomplished by removing original concrete from non-facing sides 60 and 62 of the original end anchor mechanisms 30 and 32. Then, each wire at one of the end anchor mechanisms is cut. Preferably, all buttons 44 are cut off wires 42 at one end anchor mechanism. Alternately, or preferably in addition to relieving tendon stress at an anchor mechanism, original concrete is removed around the wire bundle 36 of tendon 26 at all locations 64 (see FIG. 8) over beams 22. Each wire 42 in the wire bundle 36 is then severed at location 64. Since some stress may remain in the original wire bundle due to the natural friction between the wire bundle and the original concrete, it is preferable to sever the wire bundle at all locations 64. In addition, as discussed hereinbefore, the chloride ion concentration is greatest at locations 64 and, consequently, it is advantageous to remove original concrete in these areas. Further advantage is realized in that before replacing a new tendon, a precise profile for the new tendon can be formed in these critical locations 64 where the tendon is nearest the top surface of the slab.

Next, the original tendon, now unstressed and perhaps in a plurality of portions, is removed from the slab. More particularly, original concrete is removed from all sides of the original anchor mechanisms 30 and 32. Existing backup bars 66 (see FIG. 8) remain and should not be nicked or cut. The original concrete is removed to a point 68 where separated wires come together into wire bundle 36. The concrete around the original anchor mechanisms is removed, all wires fastened to the original anchor mechanisms are severed, and the anchor mechanisms are removed, as at locations 70 of FIG. 8.

To remove all of the severed wires in the one or more portions of the wire bundle, a pulling mechanism such as a hydraulic jack (not shown) is fastened or anchored to the slab. At least one of the severed wires is fastened to the pulling mechanism and pulled from the slab. The process is repeated until all wires have been removed.

Figures 8, 9, 14:
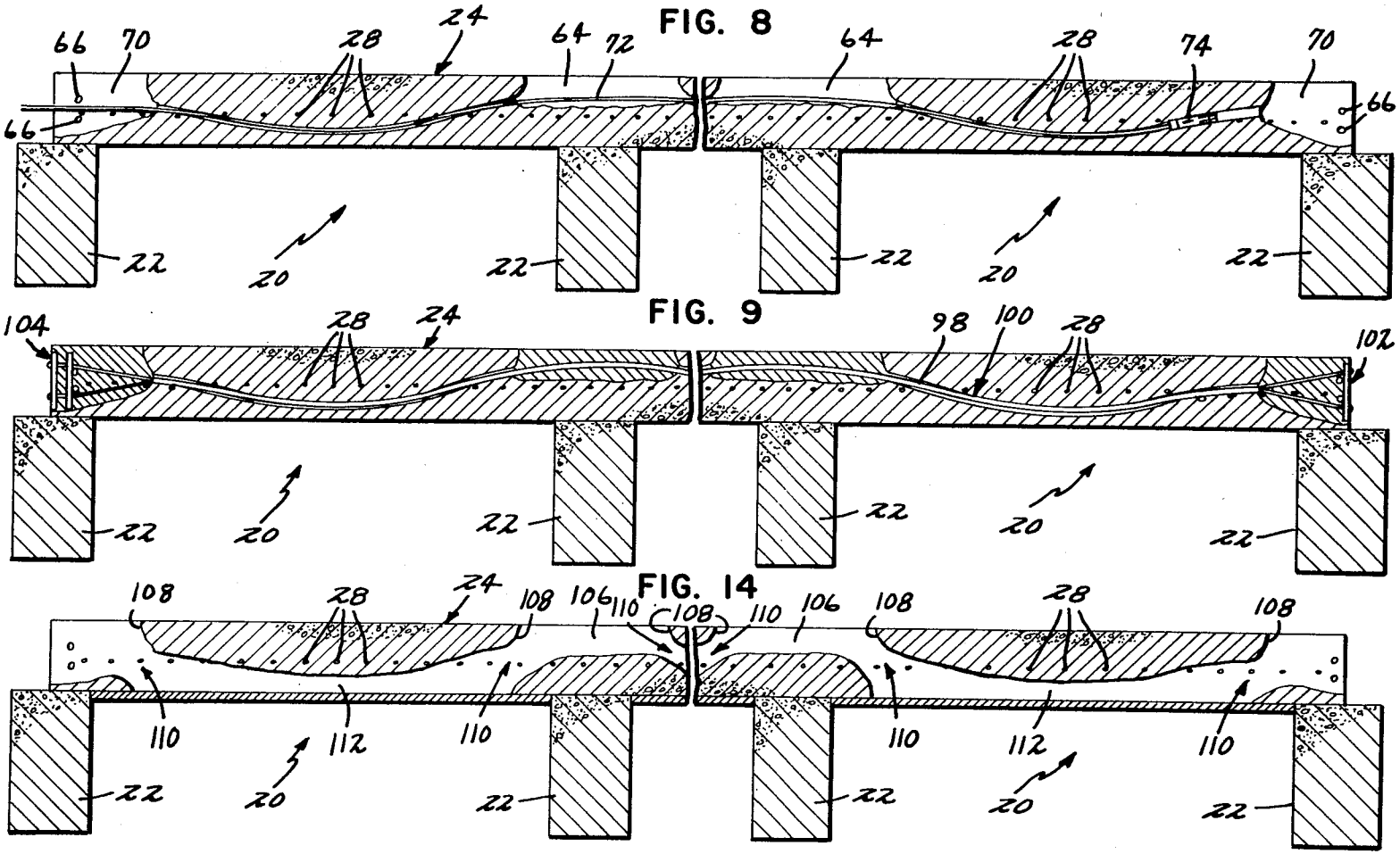
FIG. 8 is a cross-sectional, side elevation illustration of a slab with a broach being pulled through a tendon vacated passage.
FIG. 9 is a cross-sectional, side elevation illustration similar to FIG. 8 showing the passage with a newly anchored tendon.
FIG. 14 is a cross-sectional, side elevation illustration showing upright and inverted trenching for complete exposure of a defective tendon.

Then, a pulling strand is inserted or installed in the passage vacated by the original wire bundles. One end of the strand 72 is attached to a broach 74 as shown in FIG. 8, while the second end is attached to the pulling mechanism (not shown). The broach is pulled through the passage thereby cleaning or enlarging the passage. Exemplary broaches and the configurations of the passageways formed by use of the typical broaches are shown in FIGS. 10–13.

Figures 10, 11, 15, 16:
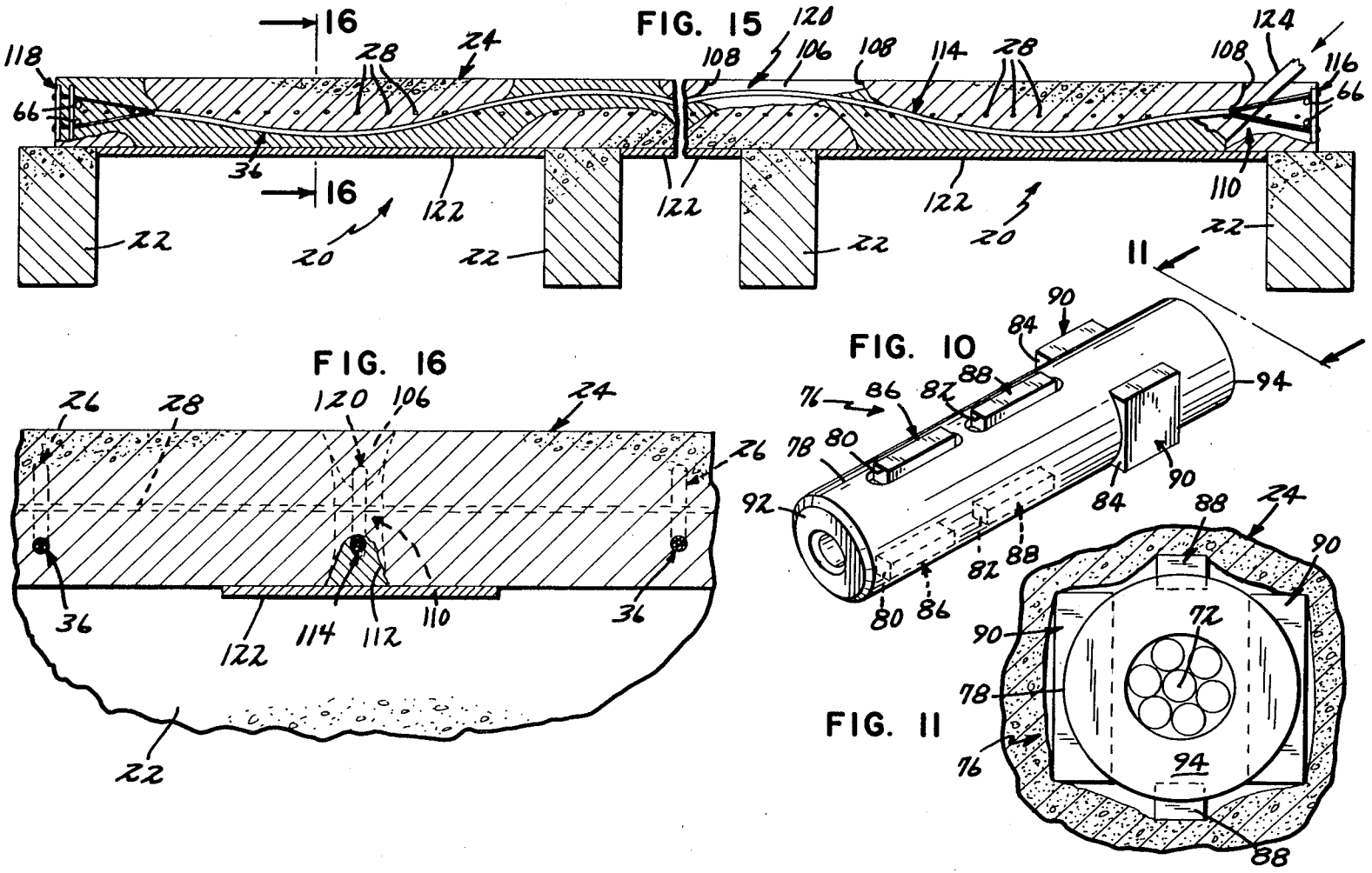
FIG. 10 is a perspective view of a broach useful for eroding a passage having an elongated cross section.
FIG. 11 shows the broach of FIG. 10, as seen along line 11—11, eroding a passage.
FIG. 15 is a cross-sectional, side elevation sketch similar to FIG. 14 and shows a new tendon with new concrete applied to an inverted trench.
FIG. 16 is a cross-sectional illustration, taken along line 16—16 of FIG. 15 showing upright and inverted trenches and a new tendon therein.

Broach 76 in FIG. 10 has a cylindrical mandrel 78 and a plurality of working surfaces 80, 82 and 84 on individual cutters 86, 88 and 90, respectively. Mandrel 78 has a nose portion 92 which is beveled in order to more easily follow the passageway. Tail portion 94 of mandrel 78 includes larger, square cutters 90 which function to keep the rear end of broach 76 aligned in the passageway. Cutters 86 and 88 are elongated steel parts oriented so an edge of an end forms the primary cutting edge 80 and 82. In broach 76, a pair of cutters 86 and 88 are attached on opposite sides of mandrel 78 and such that cutters 88 follow directly behind cutters 86. Cutters 86 and 88 are forward of larger cutters 90. The pair of cutters 90 are also attached on opposite sides of mandrel 78 at locations essentially 90 degrees offset from cutters 86 and 88. Cutters 90 are essentially square plates having the square portion of the cross-section attached to the mandrel 78. As shown in FIG. 11, broach 76 cuts or erodes a passage which is essentially rectangular in cross section with additional erosion at the center top and center bottom where cutters 86 and 88 pass.

Before pulling a broach, like 76, through a passage, all the cutter surfaces are sharpened. The cutting edges wear each time the broach is pulled through the passage causing the broach to become progressively smaller. A small broach is preferably used for a first pull in order to clean the passage. Progressively larger broaches are then used to enlarge the passage. As broaches wear, they become the smaller broaches so that a large broach must continually be added as necessary for multiple passage enlarging operations.

Figure 12:
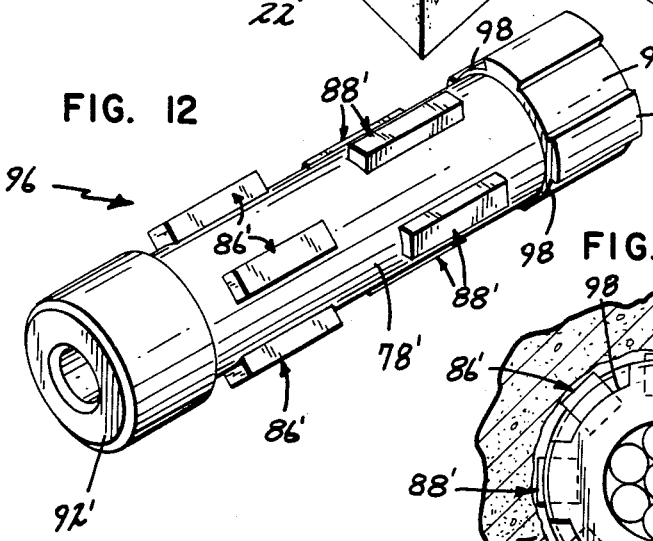
FIG. 12 is a perspective view of another form of broach.
Figure 13:
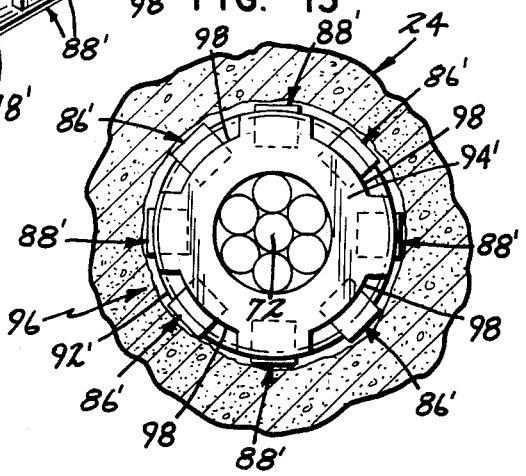
FIG. 13 is an end view, taken along line 13—13 of the broach in FIG. 12, as it erodes a passage.

An alternative form of a broach is shown as 96 in FIG. 12. Broach 96 has a cylindrical mandrel 78' with a nose portion 92' and a tail portion 94'. Nose portion 92' has a somewhat larger diameter than mandrel 78' and has a beveled front edge. Tail portion 94' has a diameter approximately the same as nose portion 92', but has a plurality of axially-parallel grooves 98 extending through it to allow cuttings to pass therethrough. A plurality of elongated cutters 86' are spaced equally about mandrel 78' just rearward of nose 92'. A plurality of cutters 88' are also spaced equally about mandrel 78', but are offset from cutters 86'. Cutters 88' are located between cutters 86' and tail portion 94'. Broach 96 erodes essentially a circular opening as shown in FIG. 13.

When the passages between end locations 70 and locations 64 have been sufficiently enlarged, a new reinforcing steel system is installed. It is understood that the prestressing steel system may come in a variety of forms including wire, strands, or bar material. A system of wire is usually assembled in groups of two or more wires of usually 0.250 inch diameter. The minimum guaranteed ultimate strength of the wire bundle is ordinarily approximately 240 thousand pounds per square inch (ksi). Strand systems are based on the use of seven wire strands of usually a nominal $\frac{3}{8}$ inch, 7/16 inch, $\frac{1}{2}$ inch, or 0.6 inch diameter twisted in a way which resembles a common cable. The minimum guaranteed ultimate strength of strand systems is generally about 250 ksi or 270 ksi. Bar systems generally utilize steel bars ranging from $\frac{5}{8}$ inch diameter to $1\frac{3}{8}$ inch diameter. The ultimate strength of bars varies from about 140 ksi to 160 ksi. In each of these types of stressing systems, the strands or bars or groups of wires may be coated, lubricated, wrapped or encased in a variety of materials, including, but not limited to, epoxy coating, a variety of greases, paper wrapping, vinyl wrapping, sheaths of polyvinylchloride (PVC), vinyl extrusions, vinyl jackets (which may be continuous and seamless or may be seamed and welded shut with heat or adhesive), polypropylene rigid or flexible metal conduits, or any other type of device, coating, or enclosure, including none at all.

New end anchor mechanisms 102 and 104 as shown in FIG. 9 and, if desired, intermediate anchor mechanisms are emplaced solidly and the wire system 98, for example, fastened therebetween to form a new tendon 100. It is understood that various anchor mechanisms are known and commercially available and are equally appropriate for the present method as long as any particular anchor system satisfies engineering specifications.

Next, concrete is cast around the new anchor mechanisms 102 and 104. Concrete may be any of a variety of formulations including, but not limited to, mixtures of a cementing material, such as portland cement, a mineral aggregate like sand, and sufficient water to cause the cement to hydrate (set or cure) and bind together. Concrete is cast around stressing anchor 104 in such a way that it can be functioned. When the concrete has set sufficiently, tensile force is applied at stressing anchor 104. The anchor is set, shimmed or locked to retain the stress level. Excess wire, if present, is cut off. Finally, additional new concrete is installed at locations 64 and 70 and anywhere else where it was necessary to remove concrete along original tendon 26. The new concrete is formed so that slab 24 reacquires substantially similar surfaces as before its repair.

Alternately, original tendon 26 may be removed by using chipping hammers to form trenches to completely expose the wire bundle from one anchor mechanism to another. That is, rather than pulling one wire after another from a passage after the wires have been severed from the anchor mechanisms and severed as desired at various locations 64, original concrete is chipped away along the wire bundle. On the top of slab 24 proceeding in both directions from a beam 22, an upright trench 106 (see FIG. 16) is formed. Upright trench 106 extends down to and slightly to each side of the wire bundle. The upright trench 106 extends along wire bundle 36 in both directions from starting beam 22. When the depth of the trench reaches a transition point 108 where wire bundle 36 is embedded in slab 24 approximately one-half the thickness of slab 24, an opening 110 the full depth of slab 24 is made. Between transition openings 110 along the bottom of slab 24, an inverted trench 112 in the original concrete is chipped to expose wire bundle 36. Inverted trench 112 extends up to and slightly to each side of wire bundle 36 in regions of slab 24 where the wire bundle 36 is embedded approximately one-half the thickness of slab 24 or more when measured from the top. That is, where wire bundle 36 is closer to the top surface, an upright trench 106 is chipped in the original concrete to expose bundle 36. Where wire bundle 36 is embedded in the concrete at a depth greater than one-half the thickness of slab 24, bundle 36 is exposed from the bottom by chipping inverted trench 112. Transistion openings 110 are formed at points 108 where wire bundle 36 passes through the mid depth of slab 24. Thus, wire bundle 36 becomes exposed on top or on the bottom at all points along its length with the transition points 108 marking points at which exposure of wire bundle 36 changes between exposure on top and exposure on bottom. All upright trenches 106 and transition openings 110 may be cut first followed by the inverted trenches 112. Alternately, a single upright trench over a beam 22 may be cut followed by a transition opening 110 and an inverted trench 112 and continuing in like manner to each end anchor. In any case, when wire bundle 36 is completely exposed, it may be easily removed from the various trenches, as shown in FIG. 14. As indicated hereinbefore, this method is also appropriate for forming a space in an existing prestressed slab for a new tendon where one had not previously been.

Next, new anchor mechanisms are solidly emplaced and new wire systems are installed in the upright and inverted trenches. The new wire system 114 is attached to the new anchor mechanisms 116 and 118 to form new tendon 120.

Then, new concrete is installed around new tendon 120 to replace any original concrete removed while removing the original tendon 26. More particularly, a form 122 (see FIG. 16) is emplaced along the underside of slab 24 under inverted trench 112 to form a bottom for the trench. New concrete is forced at trough 124 (see FIG. 15) through a transition opening 110 to fill inverted trench 112. When concrete begins coming through the next adjacent transition opening 110, it is clear that the new concrete has completely filled inverted trench 112. All inverted trenches 112 are filled and allowed to set in a similar fashion. New concrete is then cast in all upright trenches and around the new anchor mechanisms, leaving only sufficient exposure to function stressing anchor mechanism 118. When the concrete is sufficiently set, tensile force is applied to new tendon 120 at stressing anchor mechanism 118 in the conventional fashion. Anchor mechanism 118 is fixed so as to retain the stressing level in the wire system 120. Excess wire, if any, is cut off at anchor 118 and new concrete is installed in the vicinity of anchor 118 and anywhere else along tendon 120 so that slab 24 reacquires substantially similar surfaces as before removal of original concrete.

It is noted that much less than half of the original concrete is removed along original tendon 26 even though upright and inverted trenches 106 and 112 completely expose tendon 26. Thus, the problem of slab deformation as illustrated in FIGS. 4–7 does not occur. Furthermore, the removed concrete is in each case on the side of tendon 120 opposite where force is exerted by the tendon during stressing original concrete. The new concrete is in locations of compression as tensile force is applied to the tendon and, consequently, it prestresses.

The alternate method of tendon 26 removal is in some cases more advantageous since it is familiar to most workers and since the method requires the use of tools, such as chipping hammers, familiar to the workers. In addition, the alternate method alleviates the possibility of a wrong sized broach being used and possible unnecessary cracking as a result. Furthermore, the broach method sometimes requires the formation of a trench in any case to remove materials not removable by the broach. Also, the alternate method allows precise reconfiguration of the profile of the new tendon. That is, if the original tendon was too high in the locations of beams 22 or too low at locations between a pair of beams 22, the appropriate trench may be deepened. Contrarily, if the tendon was too low over the beams or too high between the beams, the appropriate trench may be partially filled with a grout before the new wire system is emplaced. Thus, the alternate method may be the preferred method for a number of situations.

A number of advantages of the inventive procedure have been expressed hereinbefore. Other advantages include the fact that only a small part of a slab needs to be available for the repair operation. This is particularly important in the case of parking ramps. Also, the repair operation can be performed by a small crew and can be done as a part of a regular maintenance problem. Thus, repair may be budgeted. Furthermore, even though all primary tendons in an entire ramp may be replaced by the present method, it is significantly less expensive than replacing the entire slab or repairing by any other known method.

It must be understood, even though these advantages and the details of the method have been discussed in detail, that the present disclosure is exemplary of the invention. Therefore, any changes, especially in matters of degree, sequence, and apparatus used, to the full extent extended by the general meaning of the terms in which the appended claims are expressed, are within the principle of the invention.

What is claimed is:

1. A method for repairing a structurally defective prestressed concrete slab, comprising the steps of:

(a) relieving substantially all stress in an original tendon;

(b) removing some original concrete along said original tendon while leaving the other original concrete along said original tendon and removing said original tendon from said slab;

(c) installing a new tendon in space in said slab vacated by said original tendon;

(d) installing new concrete around said new tendon to replace any original concrete removed in removing said original tendon; and (e) stressing said new tendon thereby again prestressing said previously structurally defective slab.

2. The method in accordance with claim 1 wherein step (a) includes the steps of:

(ai) removing original concrete from non-facing sides of original end anchor means, said original tendon including a wire bundle separable into a plurality of wires; and (aii) cutting each wire at one of said end anchor means to relieve substantially all stress in each said wire.

3. The method in accordance with claim 1 wherein step (a) includes the steps of:

(ai) removing original concrete from around said wire bundle at a location over at least one beam of said slab; and (aii) severing each wire in said wire bundle at said location.

4. The method in accordance with claim 2 wherein step (b) includes the steps of:

(bi) removing original concrete from all sides of all original anchor means;

(bii) severing all wires fastened to all said original anchor means and removing all said original anchor means;

(biii) removing original concrete in vicinity of said original anchor means to point where separated wires come together into said wire bundle; and (biv) removing all of said severed wires from said slab.

5. The method in accordance with claim 4 wherein step (biv) includes the steps of:

(11) anchoring pulling means with respect to said severed wires;

(22) fastening one of said severed wires to said pulling means;

(33) pulling said one severed wire from said slab; and

(44) repeating steps (11), (22) and (33) for each of said severed wires.

6. The method in accordance with claim 5 wherein step (c) includes the steps of:

(ci) installing a pulling strand in a passage vacated by said severed wires;

(cii) attaching one end of said strand to a broach and a second end to said pulling means;

(ciii) pulling said broach with said pulling means through said passage thereby enlarging said passage;

(civ) emplacing solidly new anchor means; and (cv) installing new wire means in said passage between and fastening said new wire means to said new anchor means, said new wire means and said new anchor means forming said new tendon.

7. The method in accordance with claim 6 wherein step (d) includes the steps of:

(di) fastening in place with concrete said new anchor means.

8. The method in accordance with claim 7 wherein step (e) includes the steps of:

(ei) applying a tensile force to said new tendon; and (eii) cutting off any excess wire at said new anchor means.

9. The method in accordance with claim 8 including the step of (f) installing new concrete so that said slab reacquires substantially similar surfaces as before removal of original concrete.

10. The method in accordance with claim 4 wherein step (biv) includes the steps of:

(11) removing to form an upright trench original concrete from the top of said slab down to and slightly to each side of said wire bundles starting at each of said beams and extending in all directions of said wire bundle to a transition point at which said wire bundle is embedded in said slab to approximately one half the thickness of said slab;

(22) removing full depth of original concrete at said transition points to create an opening;

(33) removing to form an inverted trench original concrete from the bottom of said slab up to and slightly to each side of said wire bundle in regions where said wire bundle is embedded in said slab approximately one half the thickness of said slab or more proceeding along said wire bundle whereby said wire bundle becomes exposed on top and on the bottom at all points along its length with said transition points marking points at which exposure of said wire bundle changes between exposure on top and exposure on bottom; and

(44) removing all said wire bundles of said severed wires.

11. The method in accordance with claim 10 wherein step (c) includes the steps of:

(ci) emplacing solidly new anchor means; and (cii) installing new wire means in said upright and inverted trenches between and fastening said new wire means to said new anchor means, said new wire means and said new anchor means forming said new tendon.

12. The method in accordance with claim 11 wherein step (d) includes the steps of:

(di) placing forms along the underside of said slab under said inverted trenches to form a bottom for said inverted trenches;

(dii) forcing under pressure new concrete through said transition openings to fill said inverted trenches; and (diii) casting concrete in said upright trenches.

13. The method in accordance with claim 12 wherein step (e) includes the steps of:

(ei) applying a tensile force to said new tendon; and (eii) cutting off any excess wire at said anchor means.

14. The method in accordance with claim 13 including the step of (f) installing new concrete, including around said anchor means, so that said slab reacquires substantially similar surfaces as before removal of original concrete.

15. A method for replacing an original tendon in a prestressed concrete slab, comprising the steps of:

removing original concrete from non-facing sides of original end anchor means, said original tendon including a wire bundle separable into a plurality of wires;

cutting each wire at one of said end anchor means to relieve substantially all stress in each said wire;

removing original concrete from all sides of all original anchor means;

cutting all wires fastened to said original anchor means and removing said original anchor means;

removing original concrete from around said wire bundle at locations over each beam of said slab;

removing original concrete from vicinity of said original anchor means along all wires to point where separated wires come together into said wire bundle;

severing each said wire over each said beam;

anchoring pulling means with respect to said severed wires;

fastening one of said severed wires to said pulling means;

pulling said one severed wire from said slab;

repeating said fastening and pulling steps so as to pull all severed wires from said slab;

installing a pulling strand in a passage vacated by said severed wires;

attaching one end of said strand to a broach and a second end to said pulling means;

pulling said broach with said pulling means through said passage thereby enlarging said passage;

emplacing solidly new anchor means;

installing new wire means in said passage between and fastening said new wire means to said new anchor means; said new wire means and said new anchor means forming said new tendon;

fastening in place with concrete said new anchor means;

applying a tensile force to said new tendon;

cutting off any excess wire at said new anchor means; and installing new concrete so that said slab reacquires substantially similar surfaces as before removal of said original concrete.

16. A method for replacing an original tendon in a prestressed concrete slab, comprising the steps of:

removing original concrete from an outer side of at least one original end anchor means;

releasing said tendon at said one end anchor means to relieve substantially all stress in said tendon;

removing original concrete from all sides of all original anchor means;

cutting said tendon from all said original anchor means and removing all said original anchor means;

removing original concrete from around said tendon in at least one location over one beam of said slab;

removing to form an upright trench on either side of said one beam along said tendon original concrete from the top of said slab down to and slightly to each side of said tendon to a transition point at which said wire bundle is embedded in said slab to approximately one-half the thickness of said slab;

removing full depth of original concrete of said slab at said transition point to create a hole;

removing to form an inverted trench original concrete from the bottom of said slab up to and slightly to each side of said tendon to a transition point at which said wire bundle is embedded in said slab to approximately one-half the thickness of said slab as measured from the bottom of said slab;

continuing the removal of original concrete to form upright and inverted trenches along said tendon to ends of said tendon in the vicinity of both said original end anchor means;

removing said original tendon;

emplacing solidly new anchor means;

installing a new tendon in said upright and inverted trenches between and fastening said new tendon to said new anchor means;

placing forms along the underside of said slab under said inverted trenches to form a bottom for said inverted trenches;

forcing under pressure new concrete through transition holes to fill said inverted trenches;

casting concrete in said upright trenches;

applying tensile force to said new tendon; and installing new concrete, including around said anchor means, so that said slab reacquires substantially similar surfaces as before removal of original concrete.

17. A method for installing tendon in a preexisting, prestressed concrete slab, comprising the steps of:

establishing a directional line between two end points along which to install a new tendon at a specific profile within said slab;

removing original concrete in at least one location over one beam of said slab along said directional line;

removing to form an upright trench on either side of said one beam along said directional line original concrete from the top of said slab down to and slightly to each side of the profile location to a transition point at which said profile location is approximately one-half the thickness of said slab;

removing full depth of original concrete of said slab at said transition point to create a hole;

removing to form an inverted trench original concrete from the bottom of said slab up to and slightly to each side of said the profile location to a transition point at which said profile location is approximately one-half the thickness of said slab as measured from the bottom of said slab;

continuing the removal of original concrete to form upright and inverted trenches along said directional line to the end of points;

removing original concrete around said end points for installation of anchor means;

emplacing solidly new anchor means;

installing a new tendon in said upright and inverted trenches between and fastening said new tendon to said new anchor means;

placing forms along the underside of said slab under said inverted trenches to form a bottom for said inverted trenches;

forcing under pressure new concrete through transition holes to fill said inverted trenches;

casting concrete in said upright trenches;

applying tensile force to said new tendon; and installing new concrete, including around said anchor means, so that said slab reacquires substantially similar surfaces as before removal of original concrete.

* * * * *